US005901508A

United States Patent [19]

Menzel

[11] Patent Number: 5,901,508

[45] Date of Patent: May 11, 1999

[54] BATHING ENCLOSURE FOR RETROFITTING BATHROOMS

[76] Inventor: Robert Menzel, 2039 Waltoffer Ave., North Bellmore, N.Y. 11710

[21] Appl. No.: 08/870,246

[22] Filed: Jun. 6, 1997

[51] Int. Cl.[6] ..... A47K 3/16

[52] U.S. Cl. ..... 52/34; 52/79.1; 4/612; 4/584

[58] Field of Search ..... 52/34, 35, 79.1, 52/79.9; 4/612, 596, 584, 589, 538

[56] References Cited

U.S. PATENT DOCUMENTS 3,479,778 11/1969 Johnson ..... 4/612 X
4,788,802 12/1988 Wokas .
4,987,619 1/1991 Smith .
5,375,380 12/1994 Jones .
5,473,843 12/1995 La Roche et al. ..... 4/612 X

*Primary Examiner*—Creighton Smith
*Attorney, Agent, or Firm*—DeMont & Breyer, LLC

[57] ABSTRACT

A prefabricated tub/shower enclosure, and a method for retrofitting a bathroom with same are disclosed. The enclosure consists of a molded shell having three walls, a tub portion, a ceiling and integral plumbing. In use, a portion of the tub/shower enclosure is cantilevered beyond the exterior wall of the house, allowing a larger-sized tub/shower enclosure to be incorporated into the bathroom than would otherwise be possible. The tub/shower enclosure is installed through an opening formed in an exterior wall of the house between interior framing members defining the bathroom.

16 Claims, 6 Drawing Sheets

BATHING ENCLOSURE FOR RETROFITTING BATHROOMS

FIELD OF THE INVENTION

The present invention relates generally to shower/tub enclosures for use in retrofitting a bathroom.

BACKGROUND OF THE INVENTION

Recently, a trend in home construction has been toward relatively large-size bathrooms. Such bathrooms, especially those provided for the master bedroom, tend to be significantly larger than those found in older homes. Frequently, owners of such older homes desire to renovate or retrofit such smaller-sized bathrooms with, for example, a larger tub or shower enclosure. Unfortunately, the additional room required for such a retrofit is often not available within the confines of the existing bathroom. Few options are available to such homeowners.

One option is to "stick-build" an addition to the house, which, simply for the luxury of a larger tub, may be considered by many as cost prohibitive. A second option is a building extension in the form of a "bathroom/ensuite" module including a preformed shell and external wall as disclosed in U.S. Pat. No. 5,375,380. According to that patent, the preformed shell is installed through an opening in an exterior wall of the house. The external wall, preferably embodied as a bay window, covers the preformed shell and is fit to the exterior wall of the home. According to the patent, the preformed shell may be located partially within the bay of the bay window allowing the homeowner to expand beyond the confines of an existing bathroom. It is believed that the disclosed ensuite extension requires additional foundation or other supporting structure thereunder, adding expense and complexity to such a retrofit.

The present invention is intended as a low cost, easily-implemented alternative to known bathroom retrofitting approaches.

SUMMARY OF THE INVENTION

A modular, prefabricated tub/shower enclosure for use in replacing smaller-sized tub/showers in an existing bathroom situated along an exterior wall of a home is disclosed. The enclosure consists of a molded shell having three walls, a tub portion, a ceiling and integral plumbing. In use, the enclosure is advantageously cantilevered beyond the exterior wall of the house, allowing a larger-sized tub/shower enclosure to be incorporated into the bathroom than would otherwise be possible.

The tub/shower enclosure is installed through an opening formed in the exterior wall of the house between interior framing members that define the existing bathroom. The opening formed in the exterior wall is also used for removing the existing tub. Performing the removal and installation operations through the exterior wall avoids the need to demolish, and subsequently repair, any interior walls or flooring. Little if any remodeling is required to the rest of the bathroom.

BRIEF DESCRIPTION OF THE DRAWINGS

Further features of the invention will become more apparent from the following detailed description of specific embodiments thereof when read in conjunction with the accompanying drawings, in which.

DETAILED DESCRIPTION

Figure 1:
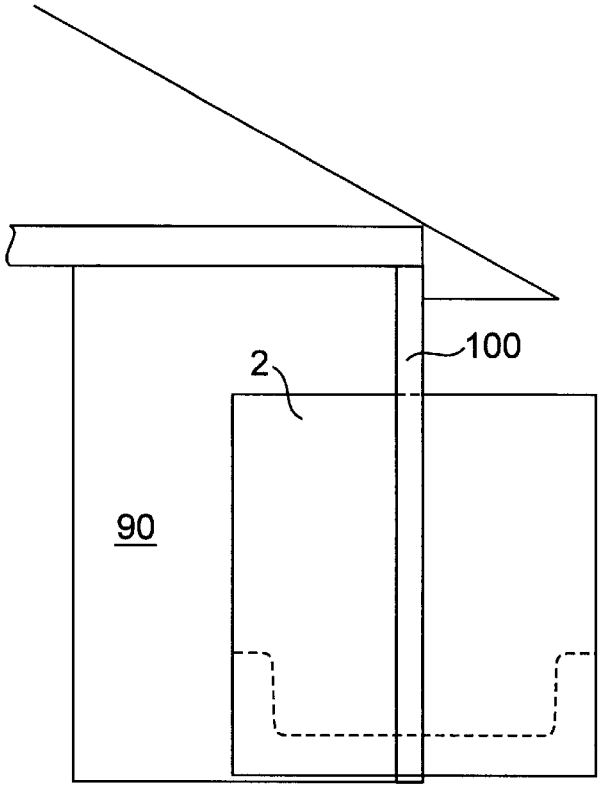
FIG. 1 shows a side cross-sectional view of a bathroom retrofitted with a tub/shower enclosure according to the present invention.

The present invention finds particular utility for retrofitting bathrooms that would otherwise be too small to accomodate larger-sized tub/shower enclosures to which the present invention is directed. For example, the ubiquitous five foot by eight foot bathroom could not hitherto accomodate a five foot by four foot tub. The ability to cantilever the present tub/shower enclosure 2 beyond exterior wall 100 of a house, as illustrated in FIG. 1, advantageously facilitates accomodating such an oversized enclosure in a small bathroom 90. Moreover, since a foundation or like supporting substructure is not required for use with the present tub/shower enclosure, the enclosure can be used to retrofit a bathroom located above the ground floor.

Figure 2:
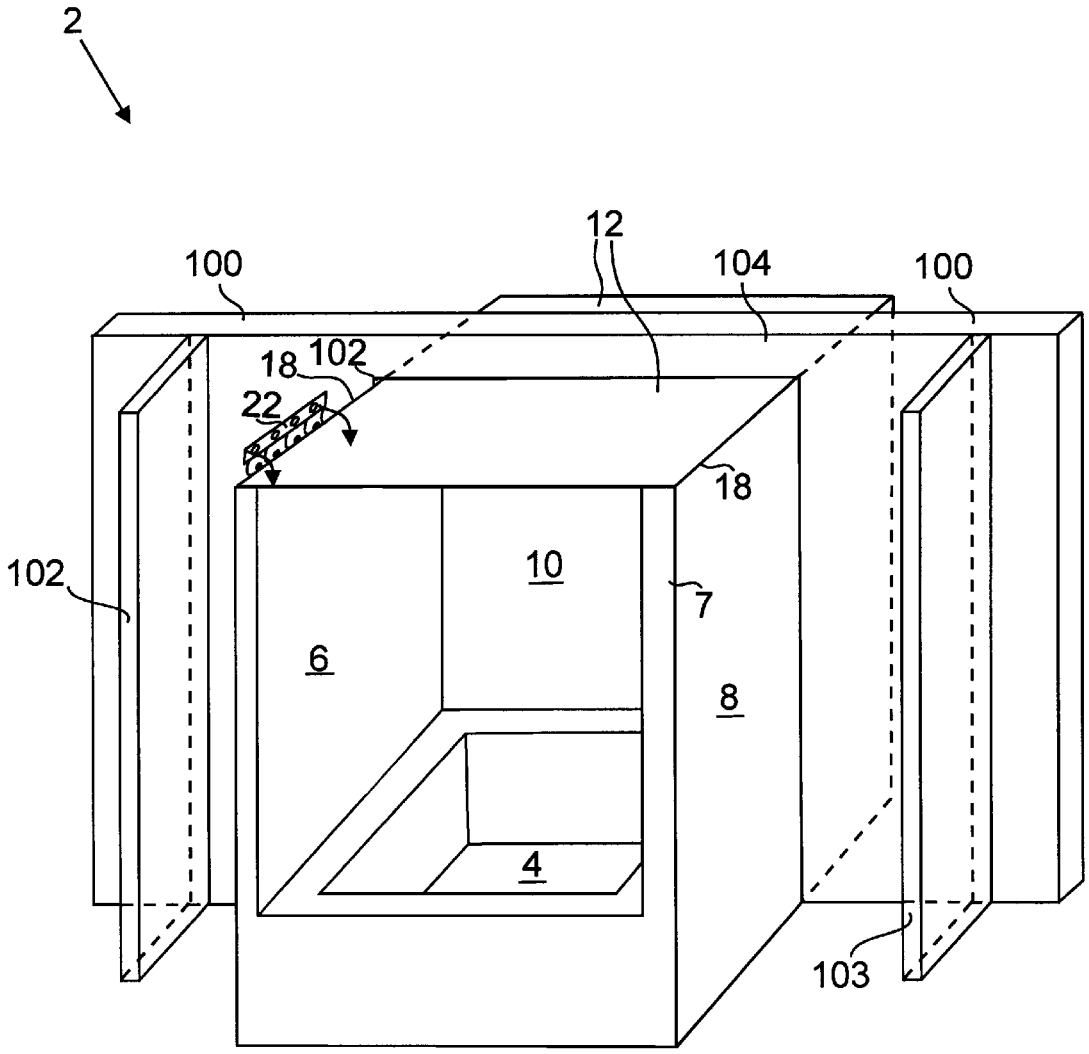
FIG. 2 is a perspective interior view of an exemplary tub/shower enclosure according to the present invention.

FIG. 2 shows an exemplary embodiment of a tub/shower enclosure 2 according to the present invention. The enclosure 2 includes a tub portion 4, side walls 6, 8 and back wall 10. A top cover 12 extends from the back wall 10 forward to the front 7 of the tub/shower enclosure. To accomodate a prefabricated tub/shower enclosure 2, and in view of the intended cantilevered relationship between the enclosure 2 and the exterior wall 100, the enclosure 2 is installed through an opening 102 formed in the exterior wall 100. The opening 102, which is formed between interior framing members 102, 103 that define the size of the bathroom, is sized to provide minimal clearance for the enclosure 2.

Figure 3:
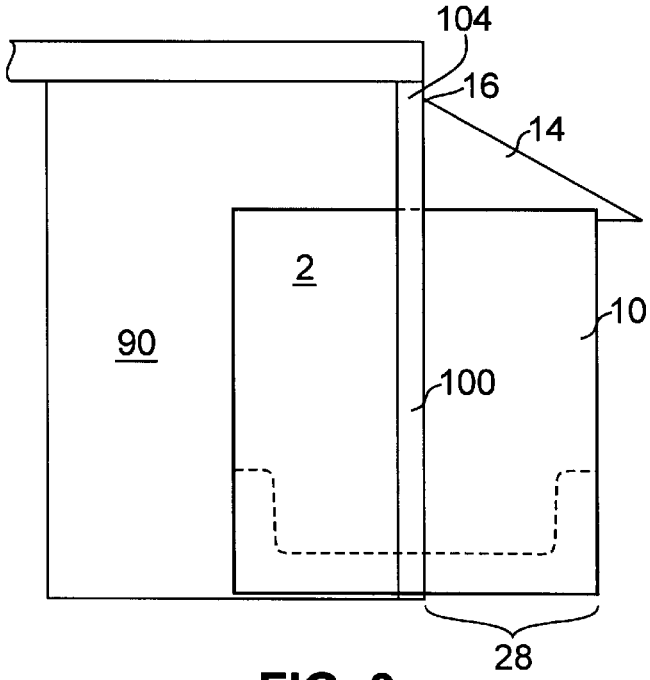
FIG. 3 shows a side cross-sectional view of a tub/shower enclosure according to the present invention with an optional roof.
Figure 5:
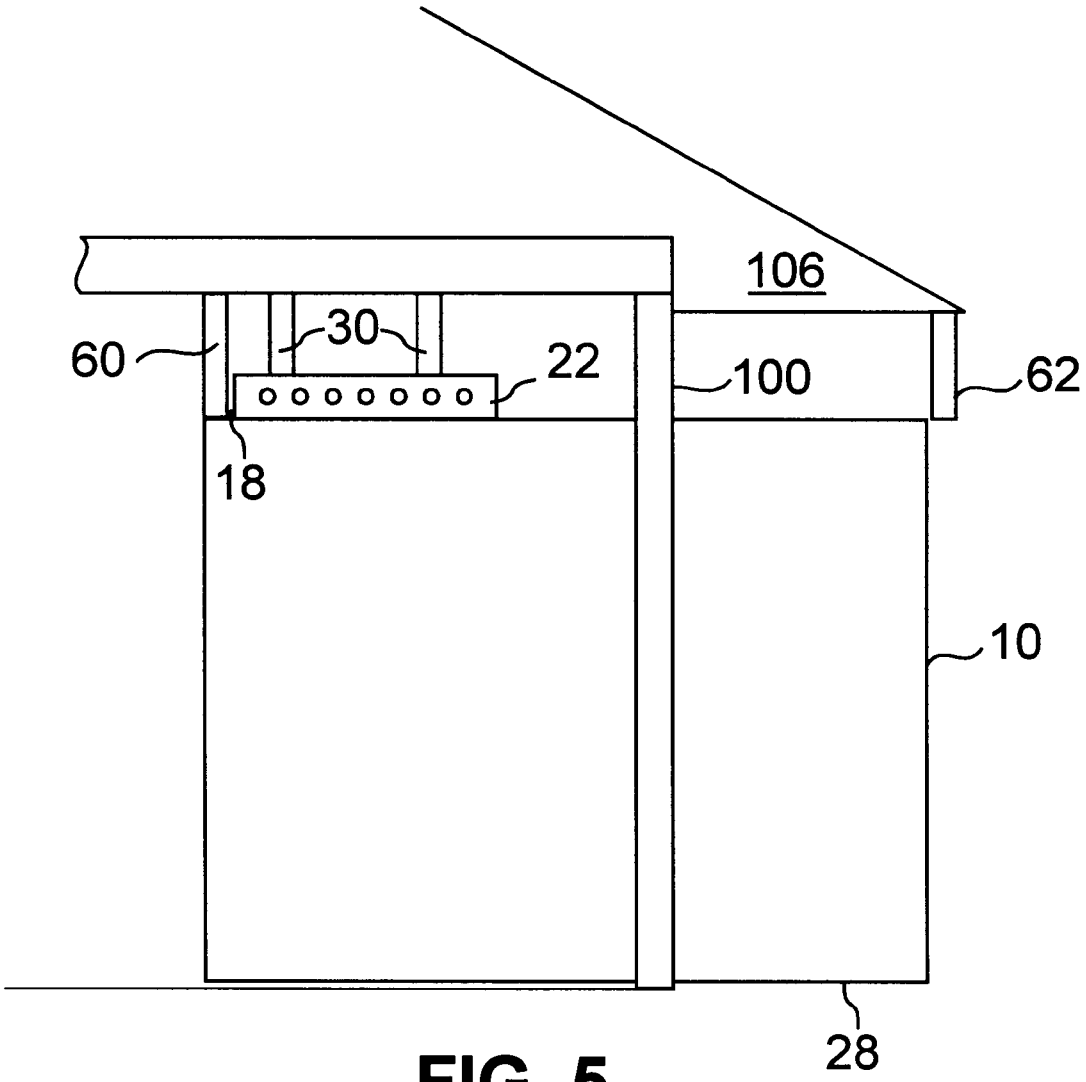
FIG. 5 shows a cross sectional view of a tub/shower enclosure according to the present invention, wherein details concerning the interior attachment of the tub/shower enclosure to building members are illustrated.

An optional roof 14, shown in FIG. 3, is disposed on the top cover 12. The roof 14 covers the cantilevered portion 28 of the enclosure 2. In the embodiment pictured in FIG. 3, the roof 14 has an apex 16 intended to abut an upper portion 104 of the exterior wall 100. The roof 14 slopes downwardly from the apex 16 towards the back wall 10. The roof 14 is characterized herein as an optional element of the enclosure 2 since its use in conjunction with the present invention is application specific. For example, if suitably located eaves or existing overhanging structure 106 is present, as illustrated in FIG. 5, the roof 14 is preferably not used.

In preferred embodiments, the tub portion 4, side walls 6, 8 and back wall 10 are provided in the form of a prefabricated enclosure. The enclosure 2 is formed from a material having a strength and durability suitable for partial cantilevering as described herein. Such materials are known to those skilled in the art and include, without limitation, reinforced fiberglass and other plastics.

Figure 4:
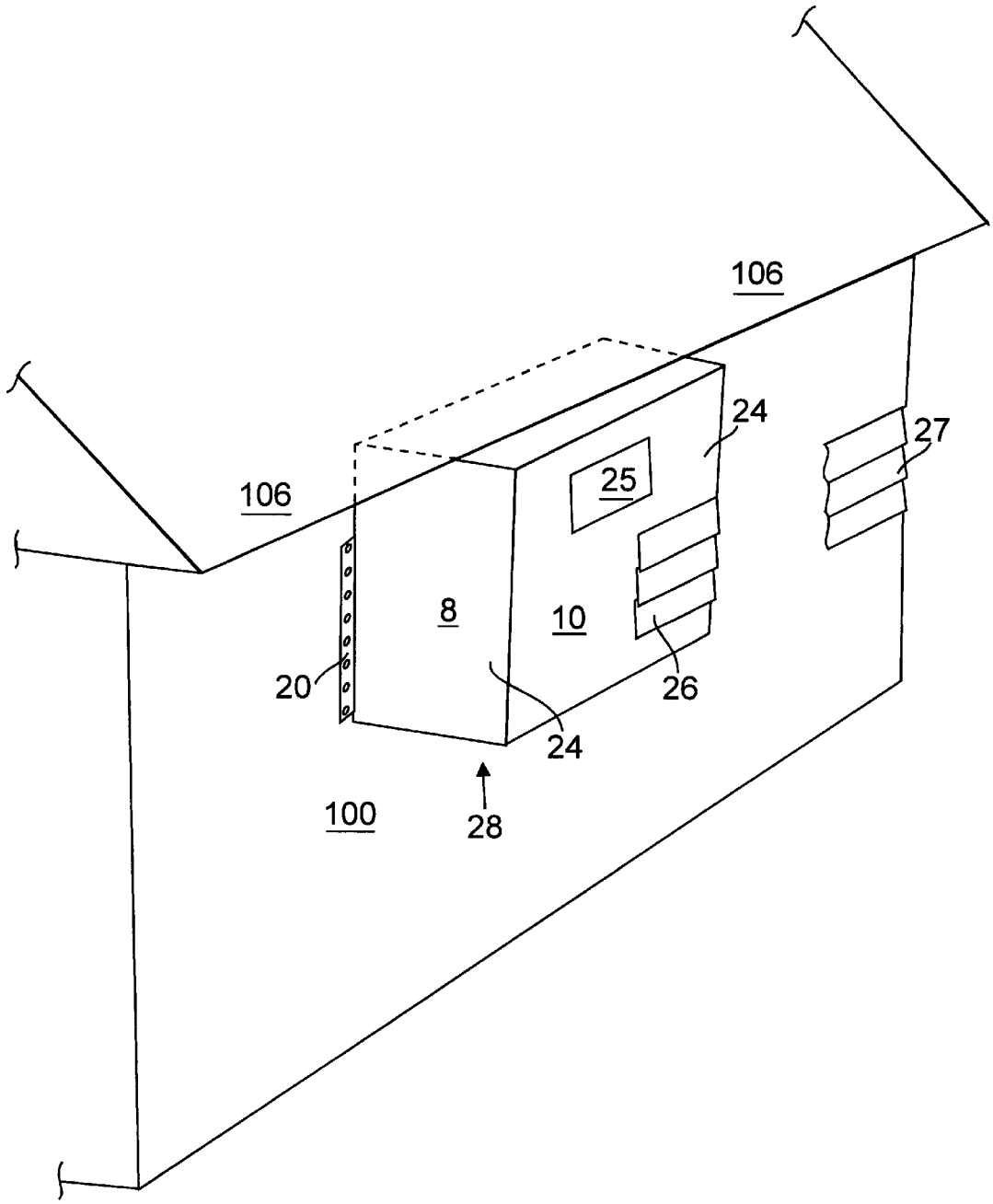
FIG. 4 shows a perspective exterior view of the cantilevered portion of the tub/shower enclosure.

Optional exterior attachment means 20 is provided for securing the enclosure 2 to the exterior wall 100 of the house, as shown in FIG. 4. The exterior attachment means 20 is positioned along sidewalls 6, 8 to provide a predetermined amount of cantilever. The exterior attachment means 20 can be, without limitation, a nailing flange or the like. An interior attachment means 22 is provided along an upper surface 18 of a portion both side walls 6, 8. As shown in FIGS. 2 & 5, the interior attachment means 22 is physically adapted for attachment to building members 30, such as vertically extending studs or the like. In the exemplary embodiment illustrated in FIGS. 2 and 5, the interior attachment means 22 is a bracket having holes for receiving bolts or the like, not shown. The building members 30 may be suitably drilled to receive such bolts, so that the interior attachment means 22 can be bolted thereto.

Since the opening in the exterior wall 100 receiving the enclosure 2 provides preferably minimal clearance, the interior attachment means 22 may not project substantially beyond the edges of the enclosure during installation. Thus, to facilitate installation while advantageously providing the convenience of a prefabricated enclosure 2, the interior attachment means 22 is hinged or otherwise retractable. It should be appreciated that in other less preferred embodiments, the interior attachment means 22 can be attached to the enclosure 2 after it is positioned within the bathroom.

A surface treatment 26, shown in part in FIG. 4, can be disposed on the surface 24 of the cantilevered portion 28 of the tub/shower enclosure 2, i.e., on the surface of the back wall 10 and portions of the side walls 6, 8, visible from outside of the house. The surface treatment 26 is suitably selected to match the existing surface treatment 27, shown in part, of the exterior wall 100 of the house. For example, the surface treatment 26 can be, without limitation, aluminum siding, cedar siding, stucco or the like, that is suitably attached to the surface 24. Alternatively, the surface treatment 26 can be an integral portion of the side walls 6, 8 and back wall 10. In such a case, the surface treatment 26 may be formed from the same material as the side walls 6, 8 and back wall 10, and is simply moulded to simulate the look of the existing siding, etc. Optionally, a window 25 can be located in the back wall 10.

Insulating material, not shown, may be placed between the cantilevered portion 28 of the enclosure and the overlying surface treatment 26 . If the surface treatment is an integral portion of the enclosure walls, then at least the cantilevered portion 28 of such walls may be double-walled with space therebetween for receiving the insulating material.

Figure 6:
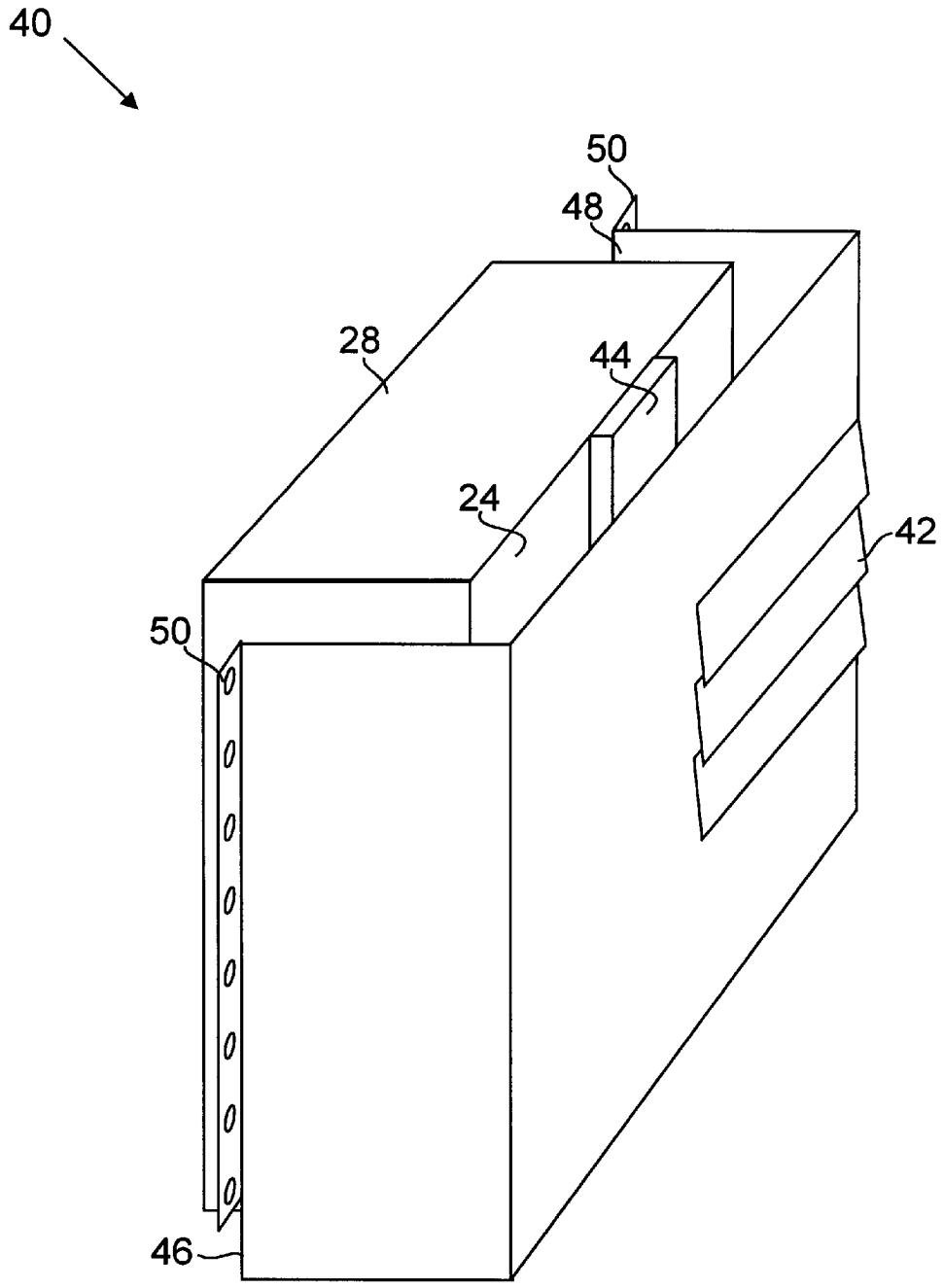
FIG. 6 shows a perspective view of an outer shell obscuring the cantilevered portion of a tub/shower enclosure according to the present invention.

In preferred embodiments, the tub/shower enclosure 2 includes an appropriately-sized outer shell 40 that obscures a view of the surface 24 of the cantilevered portion 28, as shown in FIG. 6. The outer shell 40 can be formed from a polymer or other readily-formed or -moulded material such as, for example, vinyl. The outer shell 40 has a shell surface treatment 42 that can be selected to match the existing surface treatment of the exterior wall 100 of the house. For example, the shell surface treatment 42 can be, without limitation, aluminum siding, cedar siding, stucco or the like, that is suitably attached to the outer shell 40. Alternatively, the shell surface treatment 42 can be an integral portion of the outer shell 40. In such a case, the shell surface treatment may be formed from the same material as the outer shell 42, and is simply moulded to simulate the look of the existing siding, etc.

The outer shell 40 can be attached to the cantilevered portion 28 of the back and side walls, or can be spaced therefrom. If the outer shell 40 and side walls 6,8 and back wall 10 are spaced, insulating material 44, such as insulating board, foam or the like can be placed therebetween. Attachment means 50 are provided at edges 46 and 48 of the outer shell 40 for attaching the outer shell 40 to the exterior wall 100. The attachment means 50 can be, without limitation, a nailing flange or the like.

Trim panels 60, 62, shown in FIG. 5, are used as required at interior and exterior locations, respectively, to close gaps between the enclosure 2 and existing features of the house. Trim panels may suitably be used at other locations as required to close any other gaps between the enclosure 2 and interior or exterior features of the house.

Figure 7:
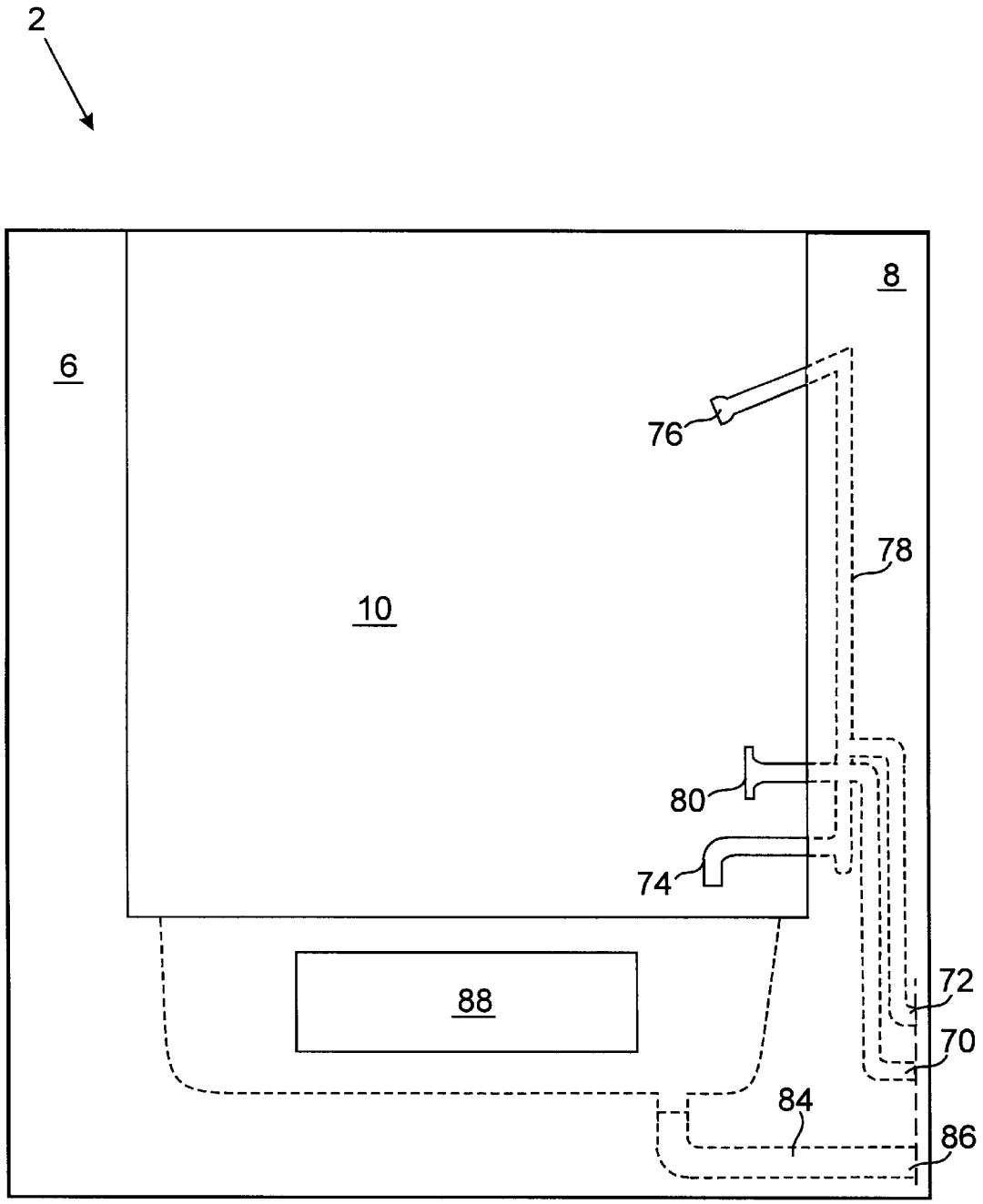
FIG. 7 shows a view of plumbing integral in a tub/shower enclosure according to the present invention.

As illustrated in FIG. 7, a tub/shower enclosure 2 according to the present invention includes plumbing hardware such as a hot water connection 70, cold water connection 72, spout 74, shower head 76, conduits 78 for delivering water to the spout and shower head, faucet handle 80 for controlling the flow of water, drain 82, conduit 84 for receiving water from the drain, and drain connection 86 to household drain line. A removable access panel 88 is provided for access to the water and drain connections.

Although specific embodiments of this invention have been shown and described herein, it is to be understood that these embodiments are merely illustrative of the many possible specific arrangements that can be devised in application of the principles of the invention. Numerous and varied other arrangements can be devised in accordance with these principles by those of ordinary skill in the art without departing from the scope and spirit of the invention.

I claim:

1. A one piece tub/shower enclosure used to retrofit a bathroom, the tub/shower enclosure comprising:

a tub section for receiving water;

interconnected first and second side walls and back wall depending from the tub section and rising vertically thereabove; and a top cover disposed on top of the back wall and on top of the first and the second side walls; wherein, the backwall, and at least a part of tub section and the first and second side walls are cantilevered beyond an exterior wall of the house when the tub/shower enclosure is installed.

2. The one piece tub/shower enclosure of claim 1, and further wherein the backwall and cantilevered part of the tub section and cantilevered parts of the first and second side walls are insulated.

3. The one piece tub/shower enclosure of claim 2, and further wherein the backwall and the cantilevered parts of the side walls visible from outside the house have a first surface treatment that is similar in appearance to a second surface treatment disposed on the exterior wall of the house.

4. The one piece tub/shower enclosure of claim 1, and further comprising a roof disposed over the backwall and the cantilevered part of the first and second side walls, wherein the roof is situated in abutting relation to the exterior wall of the house.

5. The one piece tub/shower enclosure of claim 1, and further comprising a multi-position installation device for attaching the tub/shower enclosure to a building member, wherein, the multi-position installation device is disposed near an upper edge of at least one of the first or the second side walls, and, wherein, in a first position, the multi-position installation device does not project substantially above the upper edge of the at least one side wall and, in a second position, the multi-position installation device projects above the upper edge of the at least one side wall to facilitate attaching the device to the building member.

6. The one piece tub/shower enclosure of claim 5 wherein the multi-position installation device is a hinged bracket.

7. The one piece tub/shower enclosure of claim 1, and further comprising an outer shell that obscures a view of the back wall and cantilevered portions of the side walls, wherein the outer shell has a first surface treatment that is similar in appearance to a second surface treatment disposed on the exterior wall of the house.

8. The one piece tub/shower enclosure of claim 7, and further comprising:

insulating material disposed between the outer shell and the back wall and the cantilevered portions of the sidewalls.

9. A method for retrofitting a bathroom situated along an exterior wall of a house with a tub/shower enclosure, comprising the steps of:

forming an opening in the exterior wall of the house between interior framing members defining the bathroom, wherein the opening is sized to receive the tub/shower enclosure;

inserting a first portion of the tub/shower enclosure into the opening, so that the first portion is situated within bathroom and a second portion of the tub/shower enclosure is cantilevered beyond the exterior wall of the house; and attaching the tub/shower enclosure to a building member.

10. The method of claim 9 wherein the step of forming an opening further comprises sizing the opening to provide minimal clearance between the opening and the tub/shower enclosure.

11. The method of claim 10 wherein the step of attaching further comprises moving a portion of a multi-position interior installation device from a first position in which the device can fit through the opening in the exterior wall but cannot be attached to the building member, to a second position in which the device can be attached to a building member within the bathroom.

12. The method of claim 9 wherein the step of attaching further comprises attaching an exterior installation device to the exterior wall of the house, wherein the exterior installation device is disposed on a side of the tub/shower enclosure and situated to provide a predetermined amount of cantilever.

13. The method of claim 9, and further comprising the step of:

covering the second portion of the tub/shower enclosure with an outer shell having a first surface treatment that is similar in appearance to a second surface treatment disposed on the exterior wall of the house.

14. A bathing enclosure comprising:

a tub section for receiving water;

interconnected first and second side walls and back wall depending from the tub section and rising vertically thereabove;

a top cover disposed on top of the back wall and on top of at least a portion of the first and the second side walls, wherein said tub section, said first and second side walls and said back wall comprise a first material; and thermal insulating means comprising a second material that insulates the backwall, and at least a portion of the first and second side walls.

15. The bathing enclosure of claim 14, and further wherein the backwall and at least a portion of the the first and second side walls are doubled walled.

16. The bathing enclosure of claim 15, and further wherein the insulating means is disposed in a space within the doubled-walled backwall and doubled-walled portion of the first and second side walls.

* * * * *